United States Patent [19]

Kishida et al.

[11] Patent Number: 4,961,793

[45] Date of Patent: Oct. 9, 1990

[54] HIGH-STRENGTH COLD-ROLLED STEEL SHEET HAVING HIGH R VALUE AND PROCESS FOR MANUFACTURING THE SAME

[75] Inventors: Koji Kishida; Osamu Akisue, both of Himeji, Japan

[73] Assignee: Nippon Steel Corporation, Tokyo, Japan

[21] Appl. No.: 320,268

[22] PCT Filed: Jun. 27, 1988

[86] PCT No.: PCT/JP88/00640

§ 371 Date: Nov. 18, 1988

§ 102(e) Date: Nov. 18, 1988

[87] PCT Pub. No.: WO88/10319

PCT Pub. Date: Dec. 29, 1988

[30] Foreign Application Priority Data

Jun. 26, 1987 [JP] Japan ..... 62-157892

[51] Int. Cl.[5] ..... C21D 8/04; C22C 38/16

[52] U.S. Cl. ..... 148/12 C; 148/12 F; 148/332

[58] Field of Search ..... 148/332, 12 EA, 12 C, 148/12 F; 420/89, 93

[56] References Cited

FOREIGN PATENT DOCUMENTS 55-91940 7/1980 Japan ..... 148/12 F 58-84929 5/1983 Japan ..... 148/12 C 59-76824 5/1984 Japan .

59-76825 5/1984 Japan .

61-15948 1/1986 Japan .

2066852 7/1981 United Kingdom ..... 148/12 C

*Primary Examiner*—Deborah Yee

*Attorney, Agent, or Firm*—Wenderoth, Lind & Ponack

[57] ABSTRACT

A heat-treatment-hardenable cold-rolled steel sheet having a high r value, comprising 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, and 0.8 to 2.2% of copper with the balance being iron and unavoidable elements and, optionally incorporated therein, either or both of titanium and niobium and further nickel and optionally boron. The steel sheet can be manufactured by subjecting a cold-rolled steel sheet having this composition to recrystallization annealing at a temperature of 750° C. or above and then heat-treating the steel sheet at a temperature ranging from 450° to 700° C. for 1 minute or longer. Alternatively, after the recrystallization annealing, the sheet can be cooled to a temperature of 450° C. or below within 1 minute, followed by work deformation and heat-treating the work-deformed product at a temperature of 450° C. or above to increase the strength of the steel sheet.

12 Claims, 2 Drawing Sheets

HIGH-STRENGTH COLD-ROLLED STEEL SHEET HAVING HIGH R VALUE AND PROCESS FOR MANUFACTURING THE SAME

TECHNICAL FIELD

One of the demands from users on the characteristic values of a recent cold-rolled steel sheet is to further increase the strength while maintaining excellent workability. The present invention provides a heat-treatment-hardenable cold-rolled steel sheet having a high r value satisfying these demands.

BACKGROUND ART

Examples of a high-strength cold-rolled steel sheet having a high r value include an aluminum-killed steel sheet containing phosphorus added thereto (see, e.g., Japanese Patent Publication No. 20733/1984), and an ultra-low carbon steel sheet containing titanium and niobium and, added thereto, phosphorus (see, e.g., Japanese Patent Publicatation No. 47328/1985) and a Ti-containing super-low carbon steel sheet containing P and Cu in combination (see Japanese Laid-Open Patent Application No. 61-15948). However, the tensile strength of these high-strength steel sheets is 40 to 45 kgf/mm$^2$ or less at the most. Therefore, they do not meet the above-described new demands for recent cold-rolled steel sheets.

There is an ever-increasing demand from users with respect to an increase in the performance of the material for a recent cold-rolled steel sheet having high workability. That is, in addition to an increase in the demand for parts having a complicated shape requiring high work deformation, there is an ever-increasing need of a decrease in the weight of the parts through an increase in the strength of the parts and a decrease in the thickness of the steel sheet. Further, in recent years, on the users' side of the steel sheet as well, there is an increasing need of reducing cost thought a reduction in the number of steps of working for deformation as much as possible. Therefore, conventional steel sheets do not meet at all the above-described users' demands.

The tensile strength of a high-strength steel sheet having a high r value produced in the prior art is 45 kgf/mm$^2$ at the most. It is a common knowledge in the art that in general the addition of various reinforcing elements for the purpose of increasing the strength of the steel sheet brings about a lowering in the r value with an increase in the strength thereof and therefore makes it impossible to attain a high r value in the case of a high-strength steel sheet.

The present inventors have developed a novel heat-treatment-hardenable cold-rolled steel sheet having a high r value even when the tensile strength is 45 kgf/mm$^2$ or more, and a process for manufacturing the same.

DISCLOSURE OF INVENTION

The heat -treatment-hardenable cold-rolled steel sheet having a high r value according to the present invention comprises a basic composition composed of 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, and 0.8 to 2.2% of copper with the balance being iron being unavoidable elements and, optionally incorporated therein, either or both of titanium and niobium and further nickel and optionally boron.

A first process for manufacturing a heat-treatment-hardenable cold-rolled steel sheet having a high r value according to the present invention comprises subjecting a cold-rolled steel sheet having the above-described composition to recrystallization annealing at a temperature of 750° C. or above by continuous annealing and then heat-treating the steel sheet at a temperature ranging from 450° to 700° C. for 1 min or longer. This process leaves the heat treatment hardening to be completed on the side of steel sheet manufacturers. The second process according to the present invention is a process for manufacturing a heat-treatment-hardenable cold-rolled steel sheet comprising subjecting a cold-rolled steel sheet having the above-described composition to recrystallization annealing at a temperature of 750° C. or above by continuous annealing, cooling the annealed steel sheet to a temperature of 450° C. or below within one min to give a sheet product, subjecting the same to work deformation, and heat-treating the work-deformed product at a temperature of 450° C. or above on the side of users, etc., thereby increasing the strength of the steel sheet (worked parts). The heat treatment in the second process includes a heat treatment of the fabricated product as a whole and a local heating by means of spot welding, arc welding, partial laser beam radiation, etc.

The present inventors have studied an industrial process for manufacturing a heat-treatment-hardenable cold-rolled steel sheet having a high r value according to a common continuous annealing process on a commercial scale, i.e., a continuous annealing process having a heating zone, a soaking zone, a first cooling zone, an over-aging zone, and a second cooling zone in that order, and have made an investigation on the addition of various elements alone or in combination thereof to a low carbon steel and, as a result, have found that a combination of a lowering in the carbon content with the addition of copper brings about simultaneous attainment of a high r value and a high strength by heat treatment.

In order to ensure a high r value and high ductility even when the strength is on a high level, it is necessary that the carbon content be decreased as much as possible. FIG. 1 is a graph showing the relationship between the carbon content and the r value of a steel sheet manufactured by forming an ingot of a steel comprising a basic composition composed of 0.15% of manganese, 0.02% of silicon, 0.010% of sulfur, 0.01% of phosphorus, 0.0020% of nitrogen, 0.03% of sol. aluminum, and 1.8% of copper and carbon in an amount varied in a range from 0.0015 to 0.0450%, subjecting the ingot to hot rolling and cold rolling according to an ordinary process to give a steel sheet having a thickness of 0.8 mm, maintaining the temperature at 825° C. for 1 min, cooling the steel sheet to 550° C. at a rate of 5°C./sec, and then heat-treating the steel sheet at 550° C. for 5 min. It is apparent from FIG. 1 that the steel of the present invention having a carbon content of 0.01% or less exhibits a r value by 0.4 to 0.5 higher than that of the comparative steel having a high carbon content, and a very high r value can be ensured by regulating the carbon content. Therefore, it is necessary that the carbon content be 0.010% or less. When the carbon content exceeds this range, the ductility is lowered, which makes it impossible to attain the object of the present invention. The carbon content is particularly preferably 0.0005 to 0.0030%.

FIG. 2 is a graph showing an effect of the copper content on the r value of a steel having a carbon content of 0.01% or less. It is apparent from FIG. 2 that the copper content as well contributes to the r value. The addition of copper to an extra-low carbon steel brings about an effect of increasing the strength of the steel sheet through precipitation after the completion of growth of a recrystallization texture having a high r value. FIG. 3 is a graph showing the second feature of the present invention, i.e., the relationship between the copper content and the tensile strength. This drawing shows the effect of the copper content on the tensile strength of a steel sheet manufactured by forming an ingot of a steel comprising a basic composition composed of 0.0025% of carbon, 0.15% of manganese, 0.60% of silicon, 0.015% of sulfur, 0.08% of phosphorus, 0.0025% of nitrogen, and 0.03% of sol. aluminum and, added thereto, 0 to 2.45% of copper, subjecting the ingot to hot rolling and cold rolling according to an ordinary process to give a steel sheet having a thickness of 0.8 mm, subjecting the steel sheet to recrystallization annealing at 850° C., gradually cooling the annealed steel sheet in the first cooling zone, and heat treating the cooled steel sheet at 400° C. and 550° C. for 3 min in an over-aging zone. In the drawing, curve (a) represents the tensile strength of a steel sheet which has been heat-treated at 400° C. for 3 min, and curve (b) represents the tensile strength of a steel sheet which has been heat-treated at 550° C. for 3 min. The reason why the lower limit of the copper content should be 0.8% is that when the copper content is less than 0.8% not only no increase in the strength can be attained in a treatment for a short period of time but also, as is also apparent from FIG. 3, the r value is unfavorably lowered. On the other hand, when the copper content exceeds 2.2%, the surface quality is lowered. Therefore, the upper limit of the copper content is 2.2%. The copper content is preferably 1.2 to 2.0%.

Phosphorus is an element not intentionally added in the present invention and maintained in an amount not more than 0.03%.

Silicon is usually present as an impurity in an amount of 0.03% or less. Silicon is added as an element for improving the strength of the steel sheet in an amount of 1.0% or less, preferably 0.3 to 1.0% depending upon the necessary level of the strength. When the silicon content exceeds 1.0%, a surface defect is liable to occur due to the formation of a scale accompanying hot rolling.

It is preferred from the viewpoint of enhancing the r value and ductility of the steel sheet that the manganese and sulfur contents each be low. The upper limits of the manganese and sulfur contents are 0.5% and 0.030%, respectively, and preferably 0.05 to 0.30% and 0.001 to 0.010%, respectively. The lower limit of the manganese content is 0.05% because too low a manganese content will cause a surface defect of the steel sheet.

In order to enhance the r value and to attain high ductility, the nitrogen content is preferably low 0.0050% or less.

The addition of either or both of titanium and niobium, which is made in cases of necessity respectively in amounts of 0.01 to 0.2% and 0.005 to 0.2% causes carbon and nitrogen to be fixed by these elements, so that the steel sheet is converted into a non-aging steel sheet. When the steel sheet is a non-aging one, there occurs no lowering in the ductility accompanying aging, which makes it possible to obtain a steel sheet having further improved ductility. Further, the addition of either or both of titanium and niobium brings about an effect of still further enhancing the r value of the steel sheet.

Since titanium reacts with carbon, oxygen, nitrogen, sulfur, etc. present in the steel, the titanium content should be determined by taking into consideration the amounts of these elements. In order to attain high press workability through fixation of these elements, it is necessary that titanium be added in an amount of 0.01% or more. However, the addition in an amount exceeding 0.2% is disadvantageous from the viewpoint of cost.

Since niobium as well reacts with carbon, oxygen, nitrogen, etc., the niobium content should be determined by taking into consideration the amounts of these elements. In order to attain high press workability through fixation of these elements, it is necessary that niobium be added in an amount of 0.005% or more. However, the addition in an amount exceeding 0.2% is disadvantageous from the viewpoint of cost.

Nickel, which is added in case of necessity is effective in maintaining the surface of the steel sheet in a high quality state and preventing the occurrence of hot shortness. Nickel may be added in an amount ranging from 0.15 to 0.45% depending upon the necessity.

The hot shortness of a copper-added steel occurs when a copper-enriched portion formed under a scale formed on the surface of the steel becomes liquid upon being heated above the melting point and penetrates into the austenite grain boundaries. Therefore, in order to prevent the occurrence of hot shortness in the step of hot rolling of a slab, it is ideal for the copper-enriched portion to be heated below the melting point, and it is preferred that the heating be conducted at 1080° C. or below. However, since a lowering in the heating temperature brings about an increase in the rolling load, the heating is not always conducted at a temperature of 1080° C. or below when the performance of a rolling mill is taken into account. In this case, the addition of nickel is useful. The added nickel as well is concentrated at the copper-enriched portion, which brings about a rise in the melting point of the copper-enriched portion. This effect is small when the amount of addition of nickel is less than 0.15%, while the addition of nickel in an amount exceeding 0.45% is disadvantageous from the viewpoint of cost.

The present inventors have found that boron which is also added in cases of necessity, contributes to a remarkable lowering in the $Ar_3$ point of the steel when added in combination with copper. In the hot rolling of the steel according to the present invention, it is necessary that the rolling should be completed above the $Ar_3$ point in order to maintain the material for the steel sheet in a high quality state. In the steel of the present invention, as described above, the carbon content is 0.010% or less in order to control the precipitation of copper. Therefore, the steel of the present invention has a high $Ar_3$ point, so that the rolling termination temperature should be high. On the other hand, as described above, it is preferred from the viewpoint of maintaining the surface of the steel sheet of the present invention in a high-quality state that the heating temperature be low, which brings about a difficulty accompanying the manufacturing of the steel sheet, i.e., with heating at a low temperature and termination of rolling at a high temperature. In view of the above, the present inventors have made a study on the effect of the addition of elements on the $Ar_3$ point of the copper-added extra-low carbon steel and, as a result, have found that the addition to boron brings about a remarkable lowering in the $Ar_3$ point. When the amount of addition of boron is less than 0.0001%, the absolute value of the lowering in the $Ar_3$ point is small. Therefore, the lower limit of the addition of boron is 0.0001%. On the other hand, the addition of boron in an amount exceeding 0.0030% is disadvantageous from the viewpoint of cost. The addition of boron in the above-described amount is preferred also from the viewpoint of improving the resistance to the deep drawing-induced brittleness.

With respect to the above-described addition of either or both of titanium and niobium and addition of nickel and boron, the above-described effect can be attained even when these elements are added in combination thereof.

Sol. aluminum may be present in an amount necessary for providing an aluminum-killed steel, i.e., in an amount of 0.005 to 0.10%.

Hereinbelow description will be made of the manufacturing process.

In the step of hot rolling, a high-temperature slab directly transferred from a continuous casting machine or a high-temperature slab produced by heating is hot-rolled at a temperature above the $Ar_3$ point.

With respect to the temperature of coiling after hot rolling, when coiling is conducted-at 500° to 650° C., copper is finely precipitated in the hot-rolled sheet, which brings about a delay in the recrystallization during annealing after subsequent cold rolling. Therefore, the temperature of coiling after hot rolling is 450° C. or below.

With respect to the cold rolling, it is preferred that the value of the cold rolling draft be high in order to attain a high r value. A cold rolling draft ranging from 50 to 85% suffices for attaining the object of the present invention.

The cold-rolled sheet is continuously annealed at a temperature of 750° C. or above to conduct recrystallization and, at the same time, to convert copper into solid solution. In this case, when the temperature is less than 750° C., not only the recrystallization is not completed but also no sufficient conversion of copper into solid solution can be attained. When a steel sheet having a high r value and high strength achieved by heat treatment is manufactured after continuous annealing, the steel sheet is allowed to cool to 700° to 450° C. after recrystallization annealing at a temperature of 750° C. or above and treated at this temperature for at least one min for precipitation of copper. FIG. 4 is a graph showing an effect of conditions of over-aging treatment in the continuous annealing on the tensile strength of the steel of the present invention containing 1.38% of copper. As is apparent from FIG. 4, the heat treatment at a temperature below 450° C. brings about no increase in the strength because of insufficient precipitation of copper even when the heat treatment is conducted for such a period of time as is adopted in the manufacture of a steel sheet on a commercial scale. With respect to the heat treating time, the amount of precipitation of copper is increased with an increase in the heat treating time. According to the experiments conducted by the present inventors, when the heat treating temperature is high, copper is precipitated even in a heat treatment for a period of time as short as 1 min or less (e.g., about 0.1 min). However, in this case, no sufficient precipitation occurs, and the residence time or the holding time in the over-aging treatment zone on a commercial scale is at least about 1 min. In this respect, the lower limit of the treating time for heat treatment on a commercial scale was limited to 1 min. In this process, a steel plate having a combination of a high r value with high strength is obtained at the stage of completion of the continuous annealing. In this case, when the temperature exceeds 700° C., a major portion of copper remains in a solid-solution state and is not precipitated. On the other hand, in the case of a temperature of 450° C. as well no precipitation of copper occurs because the diffusion rate of copper is low.

The present invention also provides a process for manufacturing a steel sheet which comprises subjecting a steel sheet to recrystallization annealing at a temperature of 750° C. or above and allowing the annealed steel sheet to cool to a temperature below 450° C. within 1 min after the completion of recrystallization annealing to provide a primary product, fabricating the primary product on the side of users, and heat-treating the fabricated product at 450° to 700° C. to precipitate copper, thereby enhancing the strength of the fabricated parts. In this case, when a time exceeding 1 min is taken for cooling, no sufficient supersaturated solid solution of copper can be prepared. Further, when the steel sheet is cooled only to 450° C. or above, copper is unfavorably precipitated in the stage of the primary product, which makes it impossible to sufficiently increase the ductility during fabrication.

The use of this process makes it possible to fabricate more complicated difficult-to-fabricate parts because the steel sheet is low in strength, soft and sufficiently high in ductility during the fabrication, which enables the production of high-strength parts which could not be attained in the prior art.

Heat treatment is conducted after the completion of the fabrication to enhance the strength of the fabricated product. With respect to the conditions for the heat treatment, it is necessary for the heat treatment to be conducted at a temperature of 450° C. or above for the purpose of sufficiently precipitating copper as described in connection with FIG. 4. The heating time may be, e.g., as short as 0.5 sec when the heating temperature is high. Further, the upper limit of the heating temperature is preferably 700° C.

This heat treatment may be conducted on the fabricated part as a whole in order to increase the strength of the part as a whole. Alternatively, the fabricated part may locally be heated to locally increase the strength of the part. Examples of the latter include press molding of a frame of an automobile followed by local heating with a burner or the like. In the case of the frame of a small-sized truck, a load is applied to the front half thereof because an engine is mounted on that portion. In the present stage, welding of a reinforcing sheet is conducted to cope with this problem. When the steel sheet of the present invention is used in this part, it becomes possible to increase the strength of only the portion to which a load is applied. Further, with respect to a shaft bush, the whole part has been subjected to carburization quenching or nitriding treatment after fabrication thereof in order to increase the strength of the shaft bush portion. The use of the steel sheet of the present invention enables local heating, so that a remarkable increase in the productivity can be expected.

BEST MODE FOR CARRYING OUT THE INVENTION

EXAMPLE 1

Figure 1:
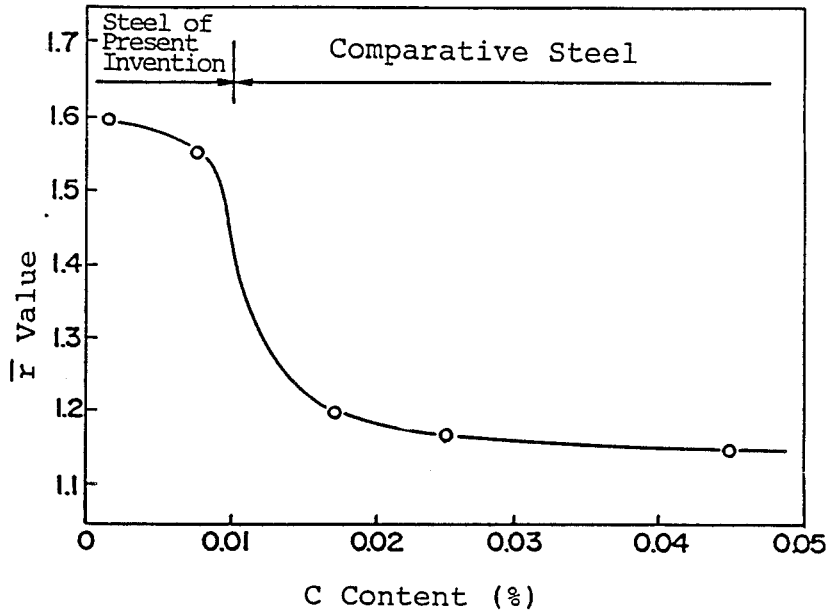
FIG. 1 is a graph showing an effect of carbon content on the r value of a cold-rolled steel sheet containing 1.8% of copper.
Figure 2:
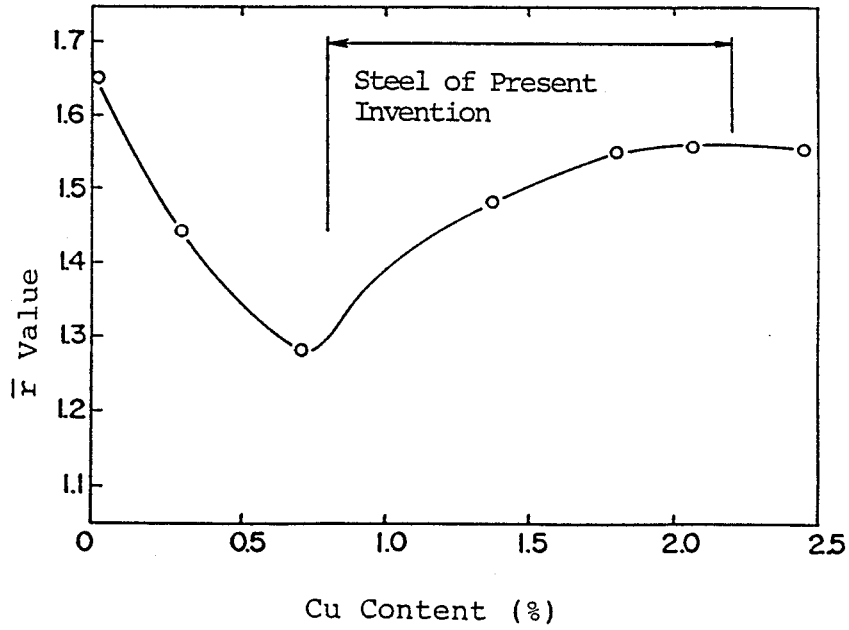
FIG. 2 is a graph showing an effect of copper content on the r value of an extra-low carbon cold-rolled steel sheet containing 1.8% of copper.
Figure 3:
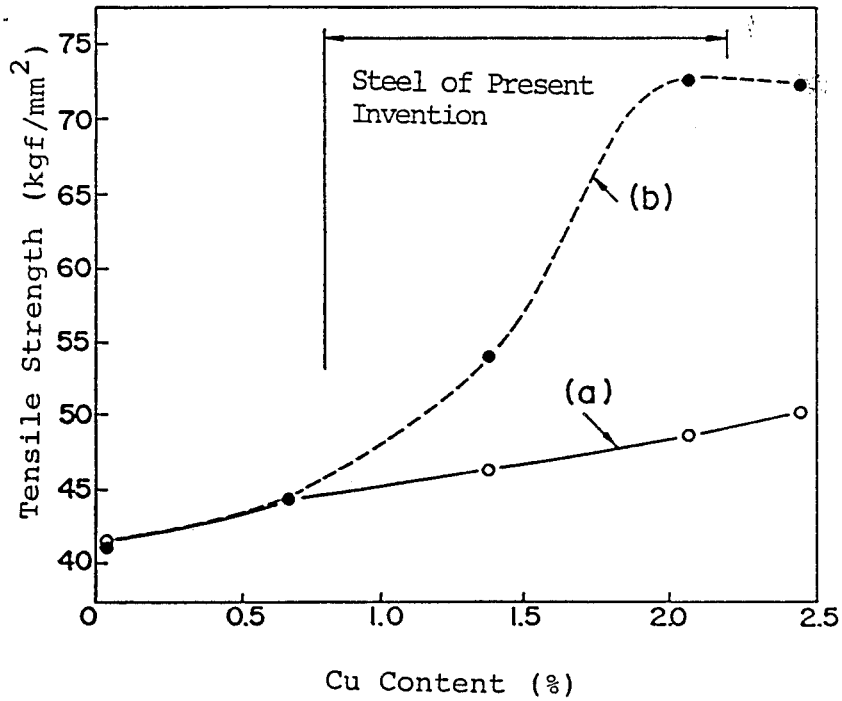
FIG. 3 is a graph showing an effect of copper content on the tensile strength of an extra-low carbon cold-rolled steel sheet wherein an over-aging condition is used as a parameter.
Figure 4:
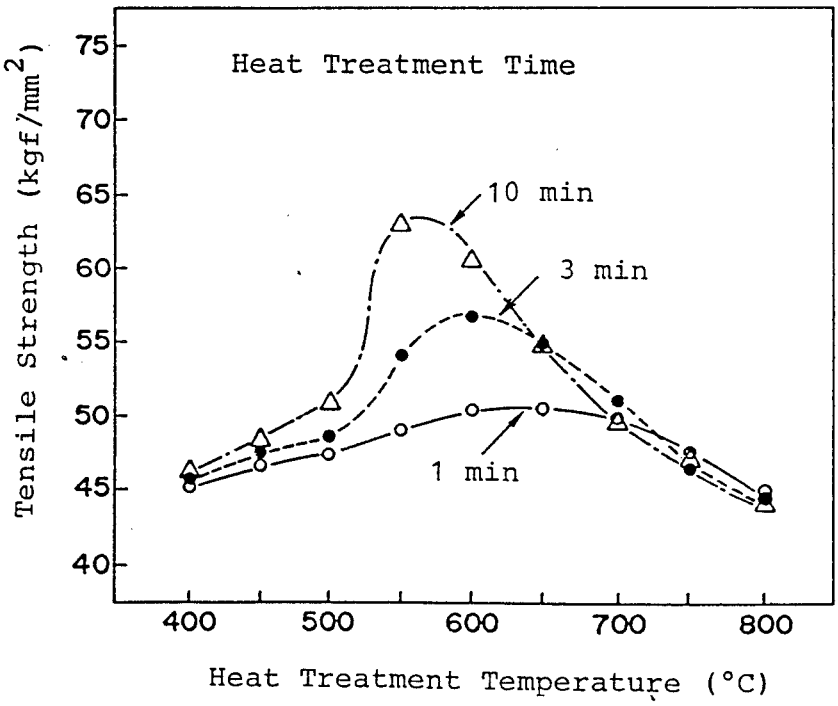
FIG. 4 is a graph showing an effect of conditions for heat treatment on the tensile strength of a cold-rolled steel sheet containing 1.38% of copper.

Steel ingots A to P shown in Table 1 were hot-rolled and then coiled under the conditions shown in Table 1, thereby preparing hot-rolled steel sheets having a thickness of 3.2 mm. These steel sheets were each cold-rolled to have a thickness of 0.8 mm and then subjected to recrystallization annealing and copper precipitation as shown in Table 1. The mechanical properties of these steel sheets are shown in Table 2.

TABLE 1

Chemical compositions (wt %) of test materials and conditions for hot rolling, cold rolling and annealing

| steel | C | Si | Mn | P | S | Al | N | Ti | Nb |
|---|---|---|---|---|---|---|---|---|---|
| A | 0.0035 | 0.02 | 0.15 | 0.008 | 0.010 | 0.01 | 0.0011 | — | — |
| B | 0.0405 | 0.01 | 0.17 | 0.007 | 0.009 | 0.03 | 0.0019 | — | — |
| C | 0.0072 | 0.02 | 0.20 | 0.007 | 0.008 | 0.03 | 0.0021 | — | — |
| D | 0.0049 | 0.02 | 0.21 | 0.010 | 0.010 | 0.03 | 0.0024 | — | — |
| E | 0.0021 | 0.03 | 0.16 | 0.015 | 0.007 | 0.04 | 0.0023 | — | — |
| F | 0.0018 | 0.03 | 0.15 | 0.010 | 0.006 | 0.03 | 0.0022 | — | 0.025 |
| G | 0.0022 | 0.02 | 0.12 | 0.012 | 0.005 | 0.04 | 0.0028 | 0.048 | — |
| H | 0.0017 | 0.03 | 0.13 | 0.013 | 0.004 | 0.04 | 0.0024 | — | 0.031 |
| I | 0.0019 | 0.03 | 0.15 | 0.017 | 0.007 | 0.03 | 0.0021 | — | — |
| J | 0.0024 | 0.03 | 0.14 | 0.015 | 0.009 | 0.04 | 0.0022 | 0.050 | — |
| K | 0.0022 | 0.03 | 0.12 | 0.018 | 0.008 | 0.05 | 0.0023 | — | 0.032 |
| L | 0.0015 | 0.03 | 0.12 | 0.013 | 0.008 | 0.04 | 0.0029 | — | — |
| M | 0.0017 | 0.03 | 0.20 | 0.018 | 0.003 | 0.03 | 0.0027 | 0.032 | 0.008 |
| N | 0.0021 | 0.03 | 0.11 | 0.017 | 0.004 | 0.03 | 0.0026 | 0.043 | — |
| O | 0.0019 | 0.03 | 0.16 | 0.016 | 0.006 | 0.04 | 0.0021 | — | 0.033 |
| P | 0.0020 | 0.04 | 0.17 | 0.018 | 0.005 | 0.05 | 0.0027 | 0.045 | 0.007 |

| steel | Cu | Ni | B | hot rolling finishing temp. (°C.) | coiling temp. (°C.) | continuous annealing (°C. × min)-(°C. × min) | remarks |
|---|---|---|---|---|---|---|---|
| A | 1.88 | — | — | 913 | 340 | 850 × 1-550 × 3 | steel of the present invention |
| B | 1.34 | — | — | 892 | 400 | 800 × 1-550 × 5 | comparative steel |
| C | 0.61 | — | — | 907 | 400 | 800 × 1-550 × 5 | comparative steel |
| D | 1.24 | — | — | 913 | 400 | 700 × 1-550 × 5 | comparative steel |
| E | 1.35 | 0.40 | — | 903 | 330 | 800 × 1-600 × 5 | steel of the present invention |
| F | 1.42 | — | — | 905 | 300 | 800 × 1-600 × 5 | steel of the present invention |
| G | 1.36 | 0.21 | — | 906 | 320 | 800 × 1-600 × 5 | steel of the present invention |
| H | 1.38 | 0.30 | — | 860 | 250 | 800 × 1-600 × 5 | steel of the present invention |
| I | 1.37 | — | 0.0004 | 852 | 240 | 800 × 1-600 × 5 | steel of the present invention |
| J | 1.34 | — | 0.0006 | 855 | 220 | 800 × 1-600 × 5 | steel of the present invention |
| K | 1.42 | — | 0.0005 | 860 | 300 | 800 × 1-600 × 5 | steel of the present invention |
| L | 1.37 | 0.25 | 0.0008 | 845 | 280 | 800 × 1-600 × 5 | steel of the present invention |
| M | 1.33 | — | 0.0003 | 865 | 260 | 800 × 1-600 × 5 | steel of the present invention |
| N | 1.39 | 0.42 | 0.0006 | 858 | 210 | 800 × 1-600 × 5 | steel of the |

TABLE 1-continued

| Chemical compositions (wt %) of test materials and conditions for hot rolling, cold rolling and annealing | | | | | | | |
|---|---|---|---|---|---|---|---|
| | | | | | | | present invention |
| O | 1.37 | 0.19 | 0.0009 | 851 | 340 | 800 × 1-600 × 5 | steel of the present invention |
| P | 1.36 | 0.32 | 0.0010 | 848 | 320 | 800 × 1-600 × 5 | steel of the present invention |

TABLE 2

| Mechanical properties of test materials | | | | | |
|---|---|---|---|---|---|
| steel | yield point (kgf/mm$^2$) | tensile strength (kgf/mm$^2$) | elongation (%) | r value | remarks |
| A | 46.2 | 58.2 | 26.3 | 1.43 | steel of the present invention |
| B | 42.1 | 52.1 | 23.9 | 1.15 | comparative steel |
| C | 21.3 | 34.0 | 37.8 | 1.50 | comparative steel |
| D | 45.0 | 56.5 | 18.1 | 1.05 | comparative steel |
| E | 42.3 | 49.8 | 33.4 | 1.52 | steel of the present invention |
| F | 44.5 | 52.4 | 28.3 | 1.46 | steel of the present invention |
| G | 42.6 | 50.2 | 30.2 | 1.51 | steel of the present invention |
| H | 41.5 | 48.9 | 34.1 | 1.49 | steel of the present invention |
| I | 41.8 | 49.2 | 31.2 | 1.43 | steel of the present invention |
| J | 40.3 | 47.4 | 35.6 | 1.56 | steel of the present invention |
| K | 46.5 | 54.8 | 27.8 | 1.57 | steel of the present invention |
| L | 40.9 | 48.2 | 33.1 | 1.46 | steel of the present invention |
| M | 41.1 | 48.4 | 35.2 | 1.62 | steel of the present invention |
| N | 44.7 | 52.6 | 29.1 | 1.54 | steel of the present invention |
| O | 44.0 | 51.8 | 29.2 | 1.58 | steel of the present invention |
| P | 43.6 | 51.3 | 29.3 | 1.66 | steel of the present invention |

The steels A and E to P according to the present invention each have a very high r value while enjoying high strength, i.e., strength exceeding 45 kgf/mm$^2$, that is, they have a unique feature which the conventional steel does not have. On the other hand, comparative steel B has a high carbon content and therefore is low in the r value as well as in elongation. Comparative steel C exhibits a high r value. However, since this comparative steel has a low copper content, no increase in the strength can be attained by heat treatment for a short period of time conducted subsequent to the recrystallization annealing, which makes it impossible to attain an intended strength. Comparative steel D is low in the r value as well as in the elongation because of insufficient recrystallization attributed to low soaking temperature in the step of the continuous annealing.

The steels A and E to P according to the present invention each have a very high r value while enjoying high strength, i.e., strength exceeding 45 kgf/mm$^2$, that is, they have a unique feature which the conventional steel does not have. However, in order to attain such excellent properties, it is necessary that hot rolling be completed in an austenitic single phase region (a temperature above the $Ar_3$ point) and that the austenitic phase be transformed into a ferritic phase in the step of cooling after hot rolling to form ferrite grains having random crystalline orientations. Since the above-described steels of the present invention each have a high $Ar_3$ point, as shown in Table 1, a high hot-rolling finishing temperature was necessary. However, as described above, a lower hot-rolling heating temperature is preferable from the viewpoint of avoiding hot shortness attributed to the addition of copper, which brings about a difficulty accompanying the manufacture of the steel sheet, i.e., with heating at a low temperature and termination of rolling at a high temperature. In order to solve this problem, boron was added in combination with copper in the case of the steels I to P according to the present invention. According to a new finding of the present inventors that the addition of boron to a copper-containing steel brings about a remarkable lowering in the $Ar_3$ point, in the steels M to T of the present invention, the hot-rolling finishing temperature was remarkably lowered as shown in Table 1. As shown in Table 2, as with the steel A of the present invention containing no boron, these steel sheets exhibit excellent mechanical properties as shown in Table 2.

EXAMPLE 2

Steels 1 and 2 shown in Table 3 were subjected to hot rolling, cold rolling and continuous annealing under the conditions shown in Table 3, thereby providing cold-rolled steel sheets each having a thickness of 1.2 mm. These steel sheets were each fabricated into a pressure vessel by press working and welding. After fabrication into pressure vessels, samples were cut out. The samples thus cut out had a sheet thickness strain of about 14%. The tensile strength of these samples per se and the tensile strength after the heat treatment (corresponding to annealing for removal of stress of the pressure vessel) at 630° C. for 5 min are shown in Table 4. In Table 4, the increment of the strength, ΔTS, was determined by subtracting the tensile strength value of the cold-rolled steel sheet before molding from the tensile strength value after press molding and heat treatment. Comparative steels softened when heat-treated after fabrication. On the other hand, the steels of the present invention exhibited a further increase in the strength through heat treatment after fabrication. The samples thus cut out had a sheet thickness strain of about 14%. The tensile strength of these samples per se and the tensile strength after the heat treatment (corresponding to annealing for removal of stress of the pressure vessel) at 630° C. for 5 min are shown in Table 4. In Table 4, the increment of the strength, ΔTS, was determined by subtracting the tensile strength value of the cold-rolled steel sheet before molding from the tensile strength value after press molding and heat treatment. Comparative steels softened when heat-treated after fabrication. On the other hand, the steels of the present invention exhibited a further increase in the strength through heat treatment after fabrication.

TABLE 3

Chemical composition (wt %) of test materials and conditions for hot rolling, cold rolling and annealing

| steel | C | Si | Mn | P | S | Al | N | Ti | Cu |
|---|---|---|---|---|---|---|---|---|---|
| 1 | 0.0038 | 0.02 | 0.17 | 0.018 | 0.008 | 0.03 | 0.0018 | 0.046 | 1.28 |
| 2 | 0.021 | 0.02 | 0.16 | 0.085 | 0.012 | 0.03 | 0.0017 | — | — |

| steel | hot rolling finishing temp. (°C.) | coiling temp. (°C.) | degree of cold rolling (%) | continuous annealing (°C. × min)-(°C. × min) | remarks |
|---|---|---|---|---|---|
| 1 | 912 | 750 | 70 | 800 × 1-400 × 3 | steel of the present invention |
| 2 | 905 | 730 | 70 | 800 × 1-400 × 3 | comparative steel |

| steel | yield point (kgf/mm²) | tensile strength (kgf/mm²) | elongation (%) | r value | remarks |
|---|---|---|---|---|---|
| 1 | 23.2 | 38.4 | 39.1 | 1.43 | steel of the present invention |
| 2 | 24.2 | 41.3 | 37.2 | 1.40 | comparative steel |

TABLE 4

| steel | tensile strength after press working (kgf/mm²) | tensile strength after heat treatment kgf/mm²) | increment of strength ΔTS (kgf/mm²) |
|---|---|---|---|
| 1 | 49.1 | 56.3 | 17.9 |
| 2 | 51.4 | 40.2 | −1.1 |

INDUSTRIAL APPLICABILITY

As described above in detail, the present invention enables for the first time the manufacture of a high-strength cold-rolled steel sheet having a high r value and a tensile strength of 45 to 75 kgf/mm².

We claim:

1. A heat-treatment-hardenable cold-rolled steel sheet having a high r value, comprising 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, and from more than 1.0, to 2.2% of copper with the balance being iron and unavoidable elements and substantially comprising a recrystallized ferritic single phase structure.

2. A heat-treatment-hardenable cold-rolled steel sheet having a high r value, comprising 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, from more than 1.0, to 2.2% of copper, and either or both of titanium and niobium in respective amounts of 0.01 to 0.2% and 0.005 to 0.2% with the balance being iron and unavoidable elements and substantially comprising a recrystallized ferritic single phase structure.

3. A heat-treatment-hardenable type cold-rolled steel sheet having a high r value, comprising 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, from more than 1.0, to 2.2% of copper, and 0.15 to 0.45% of nickel with the balance being iron and unavoidable elements and substantially comprising a recrystallized ferritic single phase structure.

4. A heat-treatment-hardenable cold-rolled steel sheet having a high r value, comprising 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, from more than 1.0, to 2.2% of copper, and 0.0001 to 0.0030% of boron with the balance being iron and unavoidable elements and substantially comprising a recrystallized ferritic single phase structure.

5. A heat-treatment-hardenable cold-rolled steel sheet having a high r value, comprising 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, from more than 1.0, to 2.2% of copper, 0.15 to 0.45% of nickel, and either or both of titanium and niobium in respective amounts of 0.01 to 0.2% and 0.005 to 0.2% with the balance being iron and unavoidable elements and substantially comprising a recrystallized ferritic single phase structure.

6. A heat-treatment-hardenable cold-rolled steel sheet having a high r value, comprising 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, from more than 1.0, to 2.2% of copper, 0.0001 to 0.0030% of boron, and either or both of titanium and niobium in respective amounts of 0.01 to 0.2% and 0.005 to 0.2% with the balance being iron and unavoidable elements and substantially comprising a recrystallized ferritic single phase structure.

7. A heat-treatment-hardenable cold-rolled steel sheet having a high r value, comprising 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, from more than 1.0, to 2.2% of copper, 0.15 to 0.45% of nickel, and 0.0001 to 0.0030% of boron with the balance being iron and unavoidable elements and substantially comprising a recrystallized ferritic single phase structure.

8. A heat-treatment-hardenable cold-rolled steel sheet having a high r value, comprising 0.010% or less of carbon, 0.05 to 0.5% of manganese, 1.0% or less of silicon, 0.001 to 0.030% of sulfur, 0.03% or less of phosphorus, 0.0050% or less of nitrogen, 0.005 to 0.10% of sol. aluminum, from more than 1.0, to 2.2% of copper, 0.15 to 0.45% of nickel, 0.0001 to 0.0030% of boron, and either or both of titanium and niobium in respective amounts of 0.01 to 0.2% and 0.005 to 0.2% with the balance being iron and unavoidable elements and substantially comprising a recrystallized ferritic single phase structure.

9. A process for manufacturing a heat-treatment-hardenable cold-rolled steel sheet having a high r value, which comprises hot-rolling a steel having a composition as defined in any one of claim 1 to 8 at a temperature above the $Ar_3$ point, coiling the hot-rolled sheet at 450° C. or below, cold-rolling the sheet, subjecting the resulting cold-rolled steel strip to recrystallization annealing at a temperature of 750° C. or above, and then heat-treating the annealed strip at a temperature of 450° to 700° C. for at least one minute.

10. A process for manufacturing a heat-treatment-hardenable cold-rolled steel sheet deformation fabrication product, which comprises hot-rolling a steel having a composition as defined in any one of claims 1 to 8 at a temperature above the $Ar_3$ point, coiling the hot-rolled sheet at 450° C. or below, cold-rolling the sheet, subjecting the resulting cold-rolled steel strip to recrystallization annealing at a temperature of 750 ° C. or above, allowing the annealed strip to cool to a temperature lower than 450° C. within one minute after the completion of said recrystallization annealing to give a product, subjecting said product to fabrication deformation, and then heat-treating the resulting fabricated product at a temperature of 450° C. or above, thereby increasing the strength of said steel sheet.

11. A process according to claim 10, wherein said heat treatment is applied to the deformation fabrication product as a whole.

12. A process according to claim 10, wherein said heat treatment is conducted by locally heating said deformation fabrication product.

* * * * *